United States Patent [19]

Smith et al.

[11] Patent Number: 4,761,113

[45] Date of Patent: Aug. 2, 1988

[54] QUICK COUPLER ASSEMBLY

[75] Inventors: Wayne G. Smith, Burlington; David V. Martinez, Fort Madison; Robert E. Mozingo; Charles B. Hanson, both of Burlington, all of Iowa

[73] Assignee: J. I. Case Company, Racine, Wis.

[21] Appl. No.: 876,594

[22] Filed: Jun. 20, 1986

[51] Int. Cl.[4] ..... B66C 3/04

[52] U.S. Cl. ..... 414/732; 414/704; 414/723; 414/912

[58] Field of Search ..... 414/704, 723, 726, 732, 414/740, 912, 724; 172/272, 274; 56/15.6, 15.9, 16.3, DIG. 9

[56] References Cited

U.S. PATENT DOCUMENTS

| | | | |
|---|---|---|---|
| 2,908,409 | 10/1959 | Hinders et al. | 414/740 |
| 4,017,114 | 4/1977 | LaBounty | 414/740 X |
| 4,187,050 | 2/1980 | Barbee | 414/723 |
| 4,203,238 | 5/1980 | Bangert et al. | 414/723 X |
| 4,225,283 | 9/1980 | Bauer et al. | 414/723 |
| 4,253,793 | 3/1981 | Braml | 414/723 |
| 4,268,217 | 5/1981 | Perreault et al. | 414/912 X |
| 4,295,287 | 10/1981 | Natzke et al. | 414/723 X |
| 4,373,852 | 2/1983 | Maurer | 414/723 X |
| 4,436,477 | 3/1984 | Lenertz et al. | 414/723 |
| 4,462,172 | 7/1984 | Caron | 414/723 X |
| 4,488,850 | 12/1984 | Wernimont | 414/723 |
| 4,519,739 | 5/1985 | Risch | 414/704 X |
| 4,586,867 | 5/1986 | Stafford | 414/723 |
| 4,643,631 | 2/1987 | Maurer et al. | 414/723 |

FOREIGN PATENT DOCUMENTS

| | | | |
|---|---|---|---|
| 2944395 | 5/1981 | Fed. Rep. of Germany | 414/704 |
| 84/02152 | 6/1984 | PCT Int'l Appl. | 414/723 |

*Primary Examiner*—Robert J. Spar
*Assistant Examiner*—P. McCoy Smith
*Attorney, Agent, or Firm*—Cullen, Sloman, Cantor, Grauer, Scott & Rutherford

[57] ABSTRACT

A quick coupler for attaching various material handling implements to a lift arm. The quick coupler includes an opening on one end for pivotal connection with the lift arm and a slotted end portion for selective engagement with a mounting pin on the implement. An intermediate portion of the quick coupler includes a mounting or coupler pin that extends laterally beyond the sides of the quick coupler. An actuating mechanism including a push-pull link is connected to the quick coupler for rotating it about the end of the lift arm. The quick coupler includes an element which may be used for lifting or positioning objects while the quick coupler is fully attached to the implement. Each implement is provided with a pair of opposed attachment members which include slots for receiving the outer laterally extending portions of the quick coupler mounting pin. After the quick coupler mounting pin is received within the slots in the attachment members, the pin is trapped therein thereby locking the quick coupler to the implement.

2 Claims, 5 Drawing Sheets

QUICK COUPLER ASSEMBLY

BACKGROUND OF THE INVENTION

The present invention relates to an apparatus for attaching various implements to the free ends of lift arms.

It is known to provide various types of material handling implements to perform numerous working operations. Changing from one implement to another is a problem because of the time and labor expended in the changeover. These implements are heavy and awkward to manipulate and many times special tools and mounting apparatus are required to make the changeover. It is an object of this invention to provide a quick coupling assembly for easily coupling and releasing different implements to the same lift arms.

The prior art is already aware of various arrangements for quickly attaching implements or the like to tractors. These devices exist in various complex forms and some of them require that the attaching pieces be accurately and carefully aligned and then the operator must maneuver a fastening or securing member in order to complete the attachment. Some of the prior art devices even require that the operator leave his seat in order to maneuver parts included in the attachment device to complete the attaching. Accordingly, it is a general object of the present invention to improve upon the prior art quick attachment devices and, specifically, to do so with a device which is simple but sturdy in construction and, therefore, is reliable in its operation and in its strength in supporting or lifting an implement.

More specifically, there has been a need for a quick attachment device which permits easy attachment and detachment of various implements without requiring the operator to leave his seat. Further, there has been a need for a quick attachment device which provides more flexibility in the types of implements that can be coupled thereto while still being compact.

The disadvantages of prior art quick attaching mechanisms have resulted in the present quick coupling assembly for attaching various material handling implements to a lift arm.

SUMMARY OF THE INVENTION

In accordance with the present invention, the improved quick coupler assembly permits various implements to be used with the same lift arm. Further, the quick coupler assembly is constructed to permit its use as a lifting device in addition to attaching or releasing various implements.

The prior U.S. patents to Baker et al, U.S. Pat. No. 4,225,283, Maurer, U.S. Pat. No. 4,373,852, Cochran et al, U.S. Pat. No. 4,545,720, and Coyle et al, U.S. Pat. No. 4,452,560, assigned to the assignee of the present invention, disclose quick coupling mechanisms that permit a bucket to be conveniently attached or released from a lift arm. The present invention provides an improvement over those mechanisms by utilizing a simpler construction which is operable with one operator using a minimum amount pf physical exertion.

The quick coupler of the present invention includes an opening on one end for pivotal connection with a lift arm. The opposite end of the quick coupler is slotted to permit selective engagement with a mounting pin on the implement. An intermediate portion of the quick coupler includes an elongated mounting or coupler pin which extends laterally from the opposed sides of the quick coupler. An actuating assembly, including a push-pull link, is connected to the quick coupler for pivoting the quick coupler about the end of the lift arm.

The quick coupler includes either a sling eye or a rotatable member with an opening therein for lifting or positioning objects using a chain or sling. The addition of the sling eye or rotatable lifting member to the quick coupler provides a particularly adaptable mechanism since the quick coupler can be fully attached to an implement and still be utilized for lifting or maneuvering other objects. The quick coupler is constructed to fit between attachment members on the implement such that the sling eye or rotatable lifting member is unobstructed thereby permitting attachment between it and a load by means of a chain or sling.

It has been found that the laterally extending mounting or coupler pin on the quick coupler provides considerable flexibility as to the types of implements which may be coupled thereto. The quick coupler may be attached to a grapple assembly which includes inner tangs and outer tangs that are pivotally interconnected. Each inner tang includes a slot which is engaged by a laterally extending end portion of the quick coupler mounting pin. Each outer tang includes a portion which traps the mounting pin within the slot upon pivotal movement between the tangs.

The operator initially maneuvers the quick coupler to capture a mounting pin on the tangs within the slotted end of the quick coupler. As the quick coupler is rotated, its mounting or coupler pin enters the slots on the inner tangs. This permits the grapple assembly to be lifted thereby allowing the outer tangs to rotate which traps the quick coupler mounting pin within the slots since portions of the outer tangs move into contact with the laterally extending portions of the quick coupler mounting pin. The rear ends of the outer tangs engage the lift arm thereby holding the outer tangs in position and permitting the inner tangs to be closed or opened relative to an object by rotating the quick coupler.

The quick coupler is also useable in connection with a hanging attachment such as an auger assembly. The upper end of the auger assembly includes a pair of opposed attachment members which are pivotally interconnected to outer guide plates. Each attachment member includes a slot and a guide ramp for assisting in the positioning of the quick coupler mounting pin. The guide plates each include a guide slot for holding the ends of the quick coupler mounting pin within the slots in the attachment members. The quick coupler is moved initially such that its slotted end engages a mounting pin extending between the attachment members. The coupler is then rolled back thereby allowing its mounting or coupler pin to enter the attachment member slots. Upon lifting the auger assembly to a full vertical position, the guide plates rotate such that their guide slots engage the laterally extending ends of the quick coupler mounting pin thereby trapping the pin within the slots.

Another implement which may be connected to the quick coupler is a fork assembly. A pair of opposed attachment plates are pivotally interconnected with fork tangs. Each attachment plate includes a slot for receiving an end of the quick coupler mounting pin. As described previously, the slotted end of the coupler is brought into engagement with the mounting pin extending between the attachment plates, and the attachment plates are lifted to a full vertical position. This causes the laterally extending ends of the quick coupler mounting pin to enter the slots in the attachment plates. The mounting pin is held within the slots by end portions of pivot members that connect the attachment plates to the fork tangs. After the attachment plates are in their vertical position, the pivot members remain stationary due to the locking engagement between their ends and the ends of the quick coupler mounting pin, thereby locking the fork assembly to the coupler.

Thus, the present quick coupler provides a mechanism which is compact and reliable in operation in various environments. A single operator can easily handle the entire coupling or uncoupling operation to various implements without special tools. Further, the present quick coupler can be used as a lifting device as well as an attachment device to various implements.

Other advantages and meritorious features of the quick coupler of the present invention will be more fully understood from the following description of the invention, the appended claims and the drawings, a brief description of which follows.

DETAILED DESCRIPTION OF THE INVENTION

Figure 1:
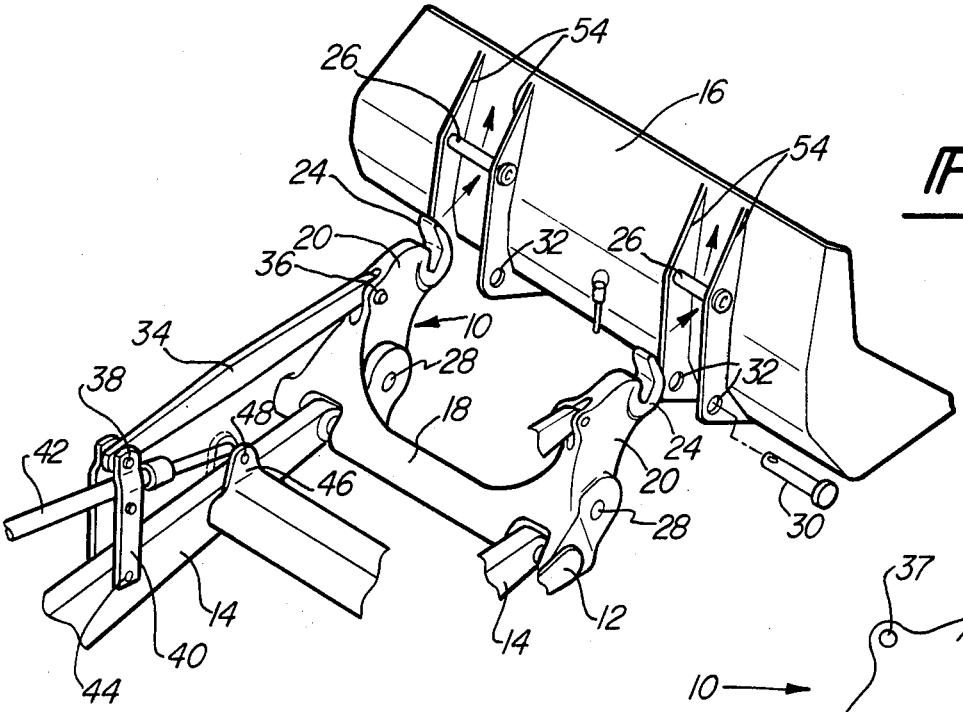
FIG. 1 is a perspective view of a quick coupler assembly which is disconnected from a bucket.

The general nature of the present invention may be understood with reference to FIGS. 1–4. The quick coupler assembly 10 is pivotally connected by pin connectors 12 to the free ends of loader arms 14. Assembly 10 may be releasably secured to or detached from bucket 16 without the operator leaving his seat.

Quick coupler assembly 10 includes a cross member 18 having hitch brackets or quick couplers 20 on its opposite ends. Each hitch bracket 20 includes an opening 22 (FIG. 3) on one end for pivotal connection with a pin connector 12 and a slotted end portion 24 for selective engagement with a permanent mounting pin 26 on bucket 16. An intermediate portion of each hitch bracket 20 includes an opening 28 such that a releasable mounting pin 30 may be passed through bucket attaching openings 32 and opening 28 thereby completing the coupled connection.

A push-pull link 34 is pivotally connected at one end to hitch bracket 20 by a pin 36 which passes through opening 37 (FIG. 3) in bracket 20. Its opposite end is connected by pin 38 to a pivotal bracket 40 which mounts piston cylinder 42. Pivotal bracket 40 is connected to loader arm 14 by pin 44 and the piston end of cylinder 42 is connected to lug 46 on loader arm 14 by pin 48. Extension and retraction of piston cylinders 42 causes assembly 10 to pivot about the ends of loader arms 14.

The operator initially maneuvers the quick coupling assembly 10 to capture the bucket mounting pins 26 within the slotted ends 24 of hitch brackets 20. The push-pull links 34 are retracted by piston cylinders 42 to align bracket openings 28 with bucket openings 32. Thereafter, releasable mounting pins 30 are inserted through the aligned openings thereby completing the connection. Bucket 16 is uncoupled by going through the steps, just described, in reverse.

Figure 2:
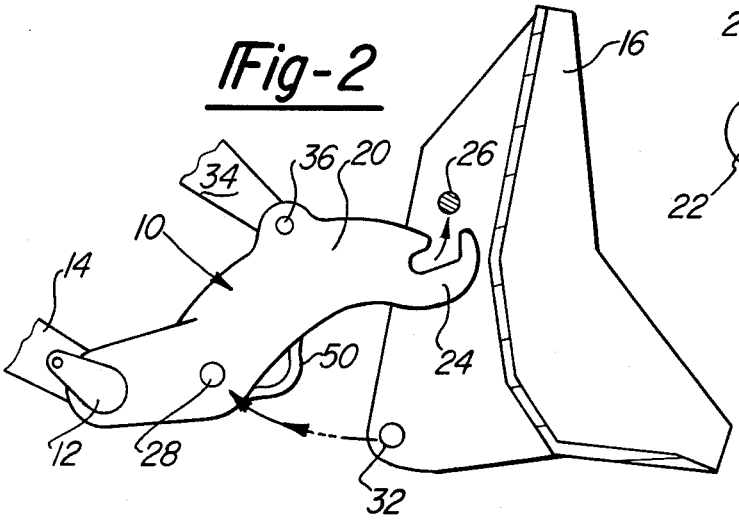
FIG. 2 is a partial side elevational view illustrating the coupling procedure for connecting the hitch bracket or quick coupler to the bucket.
Figure 3:
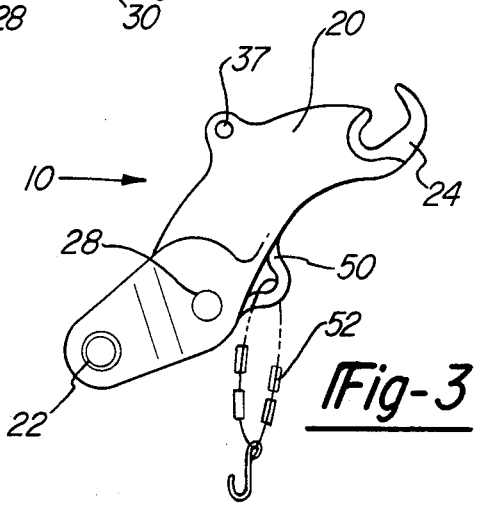
FIG. 3 is a side elevational view of one hitch bracket or quick coupler including a sling eye and lifting chain.
Figure 4:
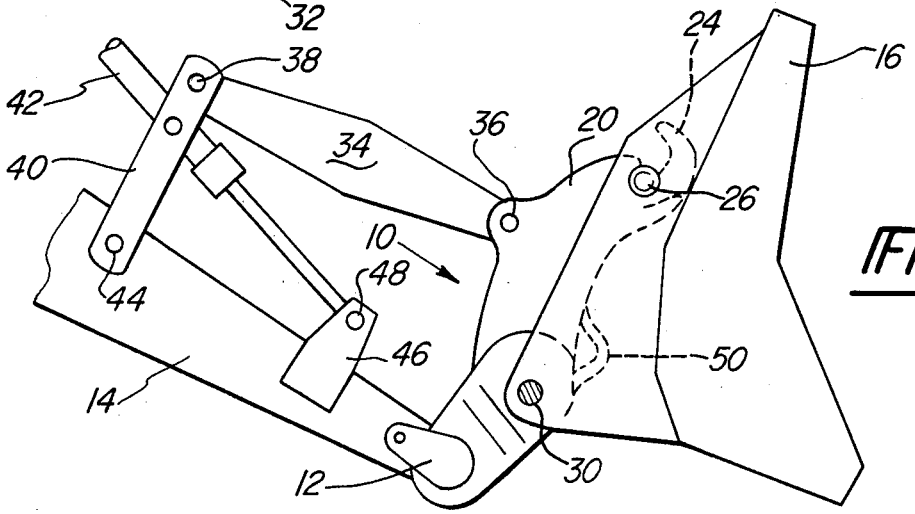
FIG. 4 is a side elevational view of the quick coupler assembly fully connected to the bucket.

As shown in FIGS. 2–4, each hitch bracket 20 includes a sling eye 50 which is located on the underside of bracket 20 for lifting or positioning objects using a chain 52 or the like. The addition of the sling eye 50 to the hitch bracket 20 provides a particularly adaptable mechanism in that the quick coupling assembly 10 can be fully attached to bucket 16 and still be utilized for lifting or maneuvering other objects. As shown in FIGS. 2 and 4, each hitch bracket 20 fits between the gusset plates 54 on bucket 16 such that the sling eye 50 is unobstructed thereby permitting its attachment with a load by means of chain or sling 52.

Referring to FIGS. 5–8, a single hitch bracket 20 is connected to an arm 56 for a backhoe. Hitch bracket 20 includes openings 57 to permit pivotal connection with arm 56 by means of pin 58. The hitch bracket 20 is connected to bucket 60 by means of a pin 62 that passes through opening 64 in the bracket. Hitch bracket 20 includes a slotted end portion 66, previously described, which engages a mounting pin 68 on bucket 60. A linkage arrangement, including piston cylinder 70, pivotal links 72, and push-pull links 74, is connected to bracket 20 by pin 76, which is selectively inserted through either opening 78 or 80 in bracket 20.

Figure 6:
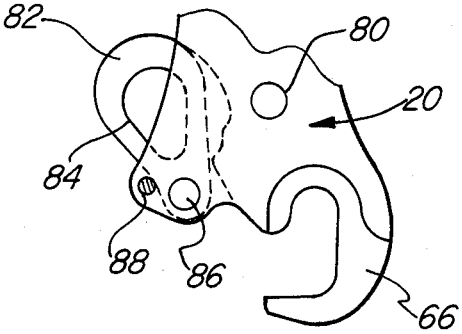
FIG. 6 is an enlarged partial side elevational view of the quick coupler illustrating the lifting device in its stored position.
Figure 7:
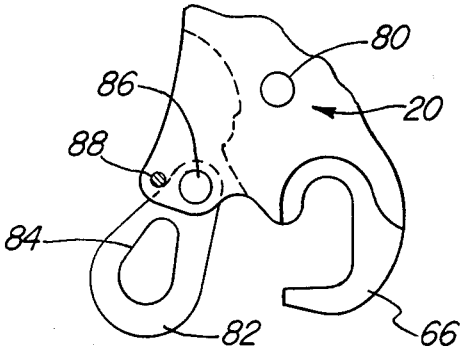
FIG. 7 is an enlarged partial side elevational view of the quick coupler illustrating the lifting device in its operating position.
Figure 8:
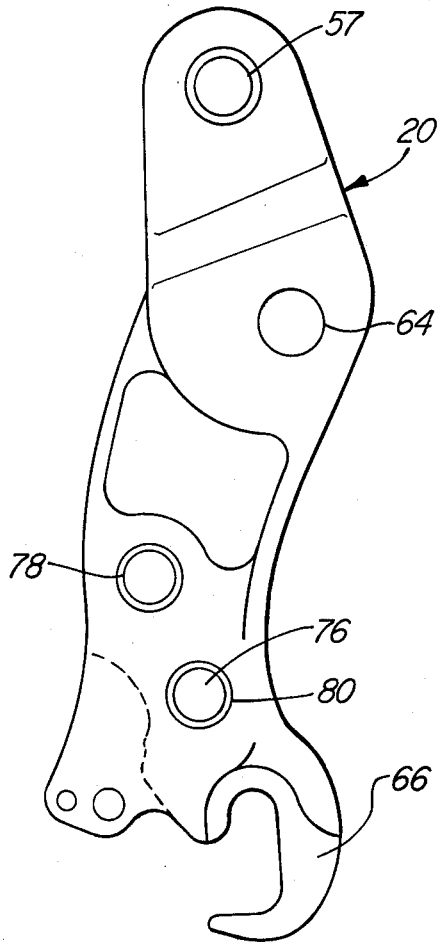
FIG. 8 is a side elevational view of the quick coupler without the rotatable lifting device.
Figure 9:
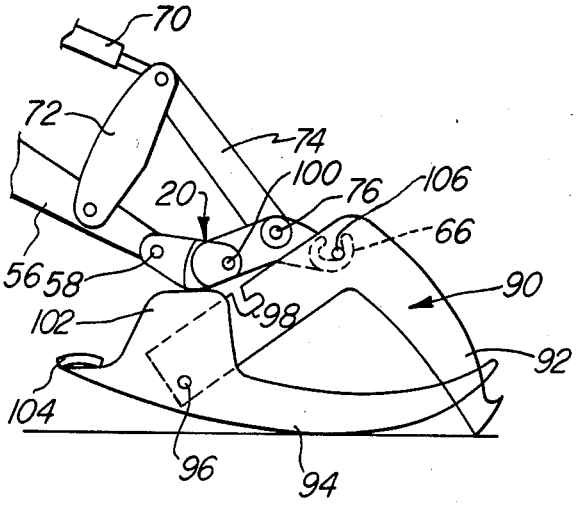
FIG. 9 is a side elevational view of a grapple assembly which is partially connected to the hitch bracket or quick coupler of the present invention.

In this construction, a lifting device 82 having an opening 84 therein is rotatably connected by pin 86 to hitch bracket 20. Lifting device 82 is rotatable to a stored position as shown in FIG. 6 where it is held by releasable pin 88. As before, the hitch bracket or quick coupler 20 can be used to conveniently connect or disconnect bucket 60 to arm 56. Alternatively, the lifting device 82 may be positioned as shown in FIG. 7, where releasable pin 88 again holds it in place, so that the quick coupler can be used for lifting various items by means of a chain or sling.

Figure 5:
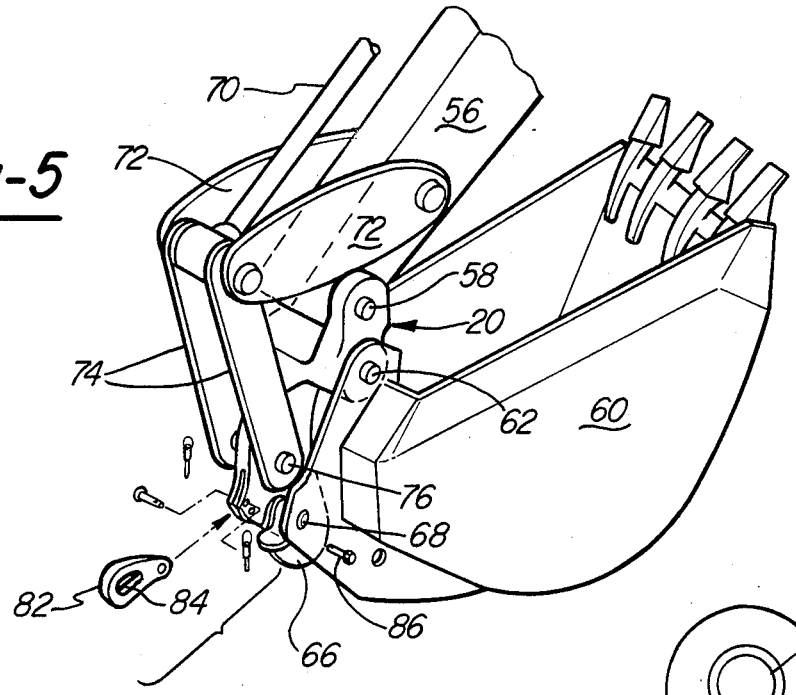
FIG. 5 is a perspective view of a bucket and the quick coupler including a rotatable lifting device.

It has been found that another modification to the hitch bracket or quick coupler 20 provides additional flexibility as to the types of implements which may be coupled thereto. Referring first to FIGS. 9–12, there is disclosed a grapple assembly 90 which can be connected to or disconnected from hitch bracket 20 without the need for the operator to leave his compartment. In this and the subsequent constructions to be described, hitch bracket or quick coupler 20 is connected to an arm 56 using the same linkage arrangement as shown in FIG. 5.

Figure 10:
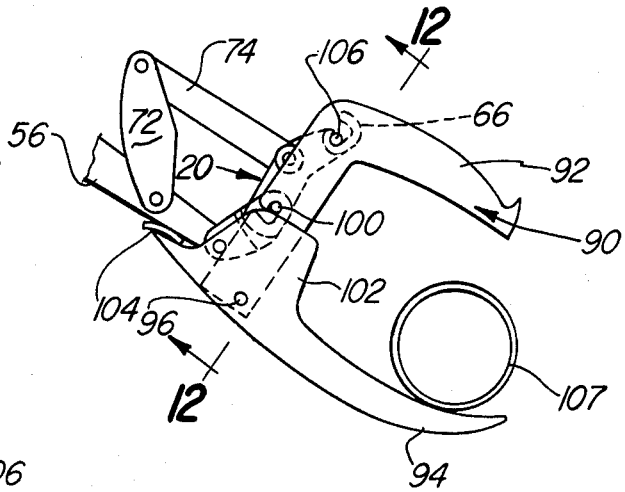
FIG. 10 is a side elevational view of the grapple assembly illustrating its open position.
Figure 11:
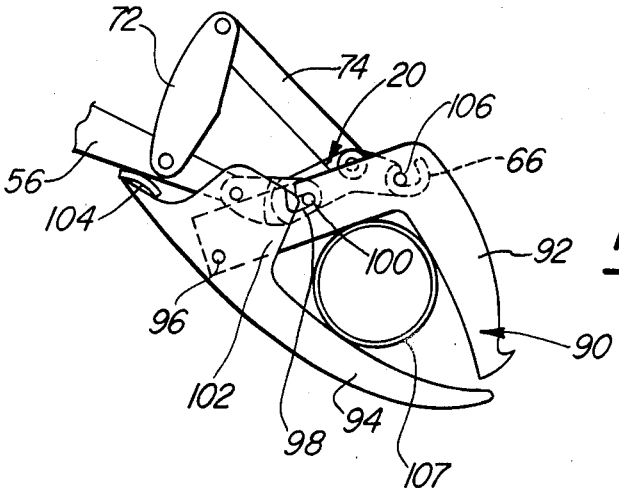
FIG. 11 is a side elevational view of the grapple assembly illustrating its closed position.
Figure 12:
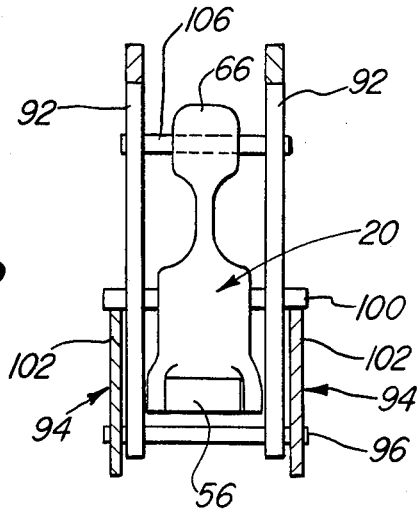
FIG. 12 is a cross-sectional view taken along line 12—12 in FIG. 10.

Grapple assembly 90 includes inner tangs 92 and outer tangs 94 which are pivotally interconnected by pins 96. Each inner tang 92 includes a slot 98 which is engaged by a long coupler pin 100 extending through hitch bracket or coupler 20. Each outer tang 94 includes a portion 102 which traps pin 100 within slots 98 and a rear end portion 104 which engages arm 56 when the grapple assembly 90 is opened as shown in FIG. 10.

In operation, the quick coupler 20 is maneuvered such that its slotted end 66 engages the mounting pin 106 extending between the inner tangs and its coupler pin 100 enters the slots 98 on inner tangs 92. The grapple assembly 90 is then lifted as shown in FIG. 10 allowing the outer tangs 94 to rotate which traps the coupler pin 100 within slots 98 since portions 102 move into contact with the laterally extending ends of pin 100. The tangs are opened and closed by extending and retracting cylinder 70. The rear ends 104 of outer tangs 94 engage arm 56 thereby holding outer tangs 94 in position and permitting the inner tangs 92 to be closed or opened relative to an object 107 by merely extending or retracting cylinder 70.

Figure 13:
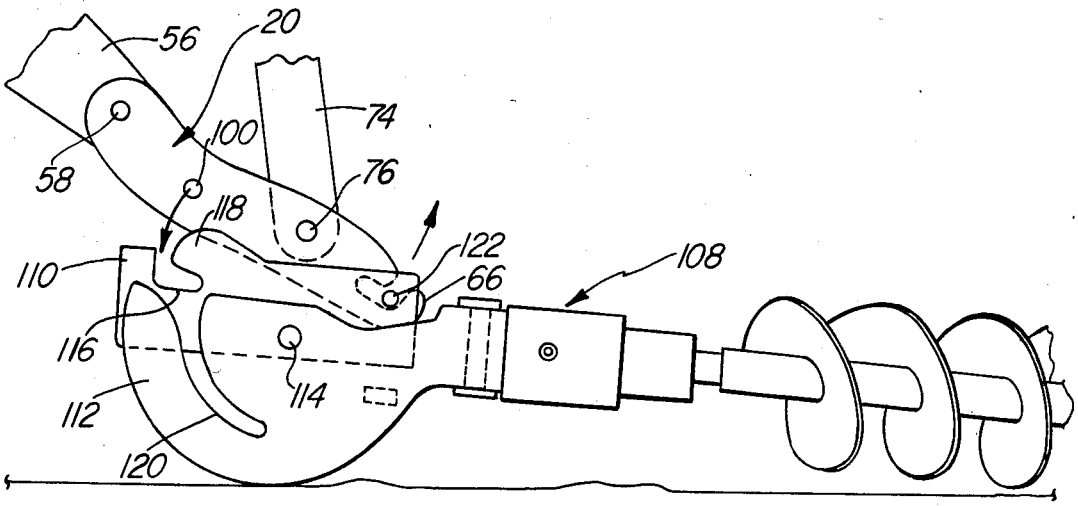
FIG. 13 is a side elevational view of an auger assembly partially connected to the hitch bracket or quick coupler of the present invention.
Figure 14:
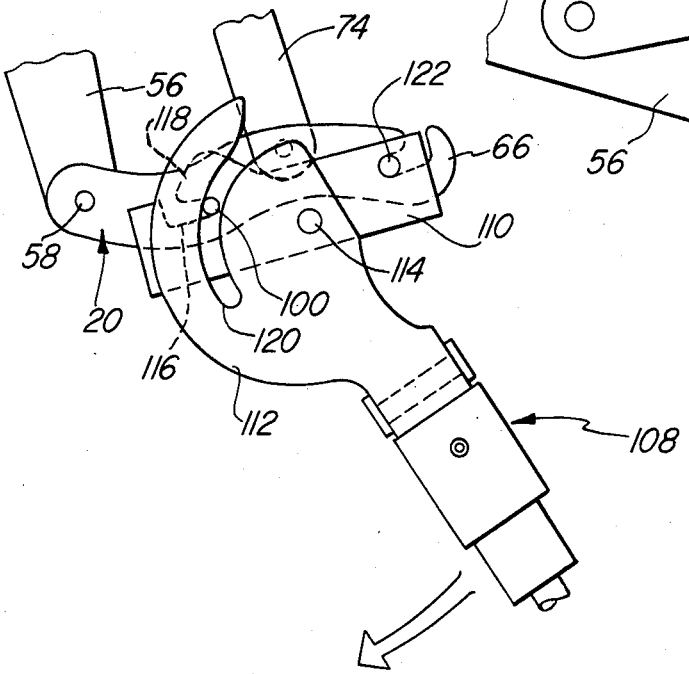
FIG. 14 is a side elevational view of the assembly shown in FIG. 13 and illustrating the engagement between guide slots and the ends of the coupler pin for the quick coupler.
Figure 15:
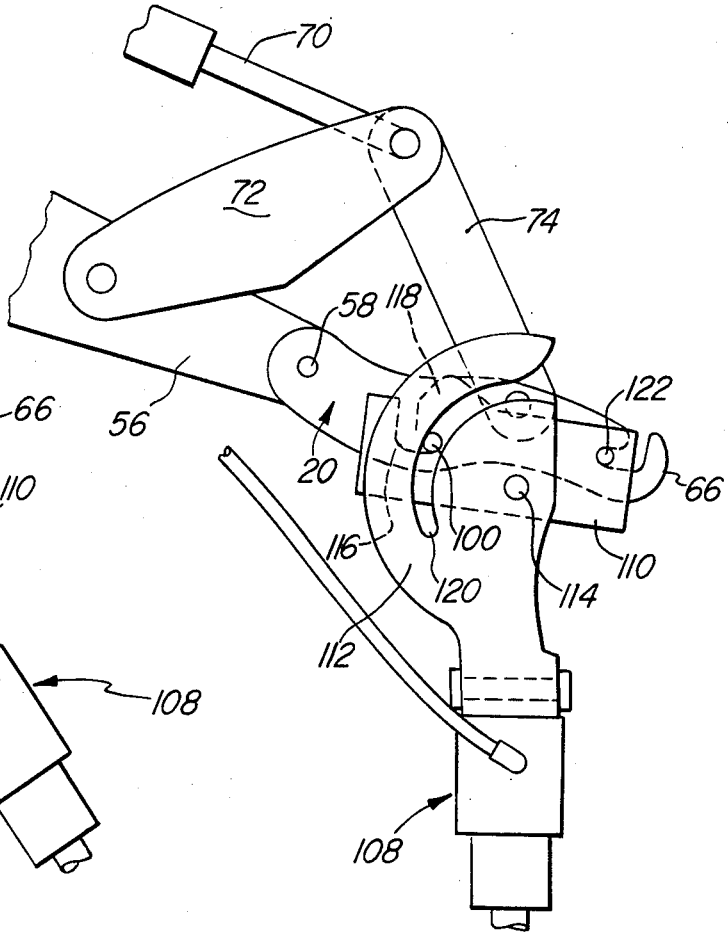
FIG. 15 is a side elevational view of the auger assembly in its full vertical position.

FIGS. 13–15 illustrate the use of the quick coupler or hitch bracket 20 in connection with a hanging attachment such as a hydraulic auger assembly 108. The upper end of auger assembly 108 includes a pair of opposed attachment plates 110 which are pivotally interconnected to outer guide plates 112 by pins 114. Each attachment plate 110 includes a slot 116 and a guide ramp 118 for coupler pin 100. The guide plates 112 each include a guide slot 120 for holding the ends of coupler pin 100 within slots 116.

The quick coupler 20 is moved initially such that its slotted end 66 engages the mounting pin 122 extending between attachment plates 110, as shown in FIG. 13. Coupler 20 is then rolled back thereby allowing coupler pin 100 to enter slots 116. Upon lifting auger assembly 108 to a full vertical position, the guide plates 112 rotate such that guide slots 120 engage the ends of pin 100 thereby trapping the coupler pin as shown in FIGS. 14–15.

Figure 16:
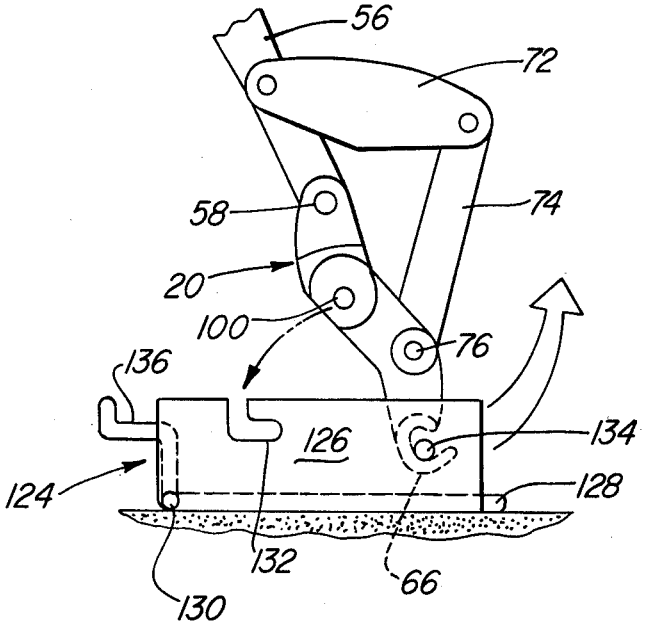
FIG. 16 is a side elevational view of a fork assembly partially connected to the hitch bracket or quick coupler of the present invention and illustrating its stored position.
Figure 17:
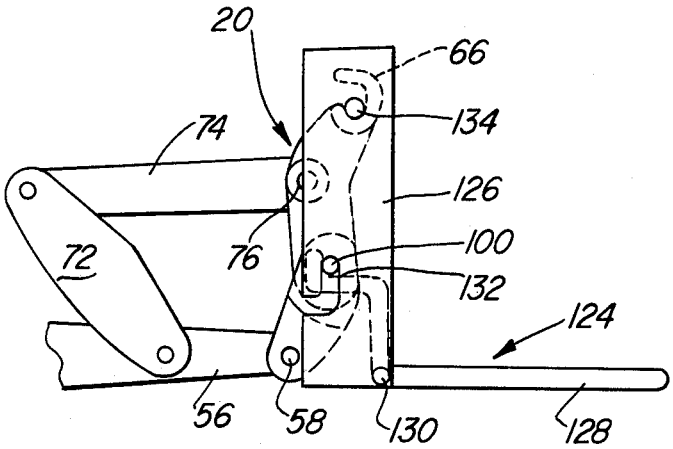
FIG. 17 is a side elevational view of the fork assembly illustrating its open and locked position.
Figure 18:
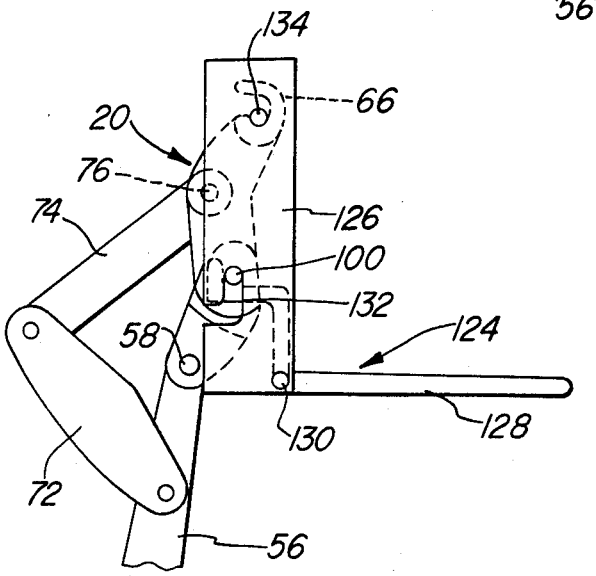
FIG. 18 is a side elevational view of the fork assembly in a lift position.

The quick coupler 20 may also be used in connection with a fork assembly 124 as shown in FIGS. 16–18. A pair of opposed attachment plates 126 are pivotally interconnected with fork tangs 128 by pivot members 130. Each attachment plate 126 includes a slot 132 for receiving an end of coupler pin 100. As shown in FIG. 16, the slotted end 66 or coupler 20 is brought into engagement with the mounting pin 134 extending between plates 126. As attachment plates 126 are lifted to a full vertical position as shown in FIG. 17, the laterally extending ends of coupler pin 100 enter slots 132 and are held within slots 132 by the locking ends 136 of members 130. After attachment plates 126 are in their vertical position, pivot members 130 remain stationary due to the locking engagement between their ends 136 and the ends of coupler pin 100, thereby locking fork assembly 124 to coupler 20.

It will be apparent to those skilled in the art that the foregoing disclosure is exemplary in nature rather than limiting, the invention being limited only by the appended claims.

We claim:

1. A quick attachment and release assembly for attaching an implement to a lift arm, said assembly comprising:

a quick coupler pivotally attached at one end to said lift arm and having an opposite slotted end for selective engagement with a mounting pin on said implement, an intermediate portion of said quick coupler including a transverse coupler pin having opposite end portions which are laterally spaced from the sides of said quick coupler, and an actuating mechanism connected between said lift arm and said quick coupler for rotating said quick coupler relative to said lift arm;

said implement including spaced apart attachment members having slots therein which receive the opposite end portions of said coupler pin and means for locking said coupler pin end portions within said slots;

said quick coupler being movable into the space between said attachment members such that its slotted end engages the implement mounting pin and the end portions of said coupler pin enter said slots for connecting said quick coupler to said implement; and said attachment members comprising a pair of first tangs, said first pair of tangs pivotally interconnected to a second pair of tangs, each tang of said second pair of tangs including a locking portion which engages an end portion of said coupler pin within a respective slot upon relative movement between said first and second pairs of tangs.

2. The assembly as defined in claim 1 wherein said second pair of tangs include ends which engage said lift arm for permitting the pairs of tangs to be opened and closed relative to each other.

* * * * *